United States Patent [19]

Pitkin et al.

[11] 4,060,222

[45] Nov. 29, 1977

[54] PREFABRICATED FENCING SYSTEM

[76] Inventors: Sheldon Pitkin, 17 Verdin Drive, New City, N.Y. 10956; Richard Varcadipane, R.D. 3 - Box 542-D, Sussex, N.J. 07461; Walter H. Poppe, 7 Alexander Ave., Waldwick, N.J. 07463

[21] Appl. No.: 698,504

[22] Filed: June 22, 1976

[51] Int. Cl.[2] ..... B21F 27/00

[52] U.S. Cl. ..... 256/50

[58] Field of Search ..... 256/1, 19, 59, 65, 50; 46/31

[56] References Cited

U.S. PATENT DOCUMENTS

| | | | |
|---|---|---|---|
| 2,628,823 | 2/1953 | Rhome et al. | 256/19 |
| 2,997,277 | 8/1961 | Schwartz | 256/19 |
| 3,002,493 | 10/1961 | Galamba | 256/59 |
| 3,499,631 | 3/1970 | Heldenbrand | 256/59 |
| 3,648,404 | 3/1972 | Ogsbury | 46/31 |

*Primary Examiner*—Werner H. Schroeder
*Assistant Examiner*—Doris L. Troutman
*Attorney, Agent, or Firm*—Hopgood, Calimafde

[57] ABSTRACT

A prefabricatedfence is formed by a plurality of upright poles and a plurality of horizontal rails disposed between the poles. Each pole carries a plurality of bulb-shaped connection members projecting radially therefrom. The poles are positioned by pointed rods inserted axially therethrough and driven into the ground. The rails define cylindrical openings at their ends, and the openings slidably engage the connection members whereby the rails are supported at their ends.

15 Claims, 6 Drawing Figures

PREFABRICATED FENCING SYSTEM

A BACKGROUND OF THE INVENTION

The present invention relates to a new and improved fence, and more particularly to a prefabricated fence that can be readily assembled and disassembled on site.

Conventional fences suffer from the disadvantage of being difficult and costly to erect. This is particularly true of post and rail fences of the type that are often made of roughly debarked wood. These fences require that post holes of substantial diameter be dug, which is time consuming and costly. Such post holes are particularly undesirable if the fence is not to be permanent. Moreover, the wood of which such fences are constructed is subject to rotting and termite infestation.

Another disadvantage of such conventional wood fences is that they are heavy, thus increasing shipping costs and making erection more difficult. They also require precision on site cutting if rails are to be joined to posts at angles which permit the fence to form corners and follow the contour of the land.

Prefabricated non-wood fences that have been devised previously have not been entirely satisfactory. One such prior art fence is disclosed in U.S. Pat. No. 3,700,213 to Blease issued on Oct. 24, 1972. That fence is not, however, easily installed and is not readily disassembled.

SUMMARY OF THE INVENTION

The present invention is a prefabricated fence, in the form of both an unassembled kit and erected fence that overcomes many of the above-mentioned disadvantages of conventional fences. The fence includes a plurality of bulb-shaped connection members projecting radially outwardly therefrom in at least two opposite directions. A plurality of rails are horizontally disposed between said poles, said rails defining cylindrical openings axially aligned with said rails at their ends. The openings are dimensioned to surround and slidably engage the connection members. The rails are thus supported and held in place at their ends by the connection members when the fence is assembled.

The fence thus constructed is capable of forming corners and following the contour of the land. It is easily assembled and disassembled and is relatively maintenance free. A preferred fence post construction utilizes a rod driven axially through the post into the ground to eliminate the need for post hole digging.

A BRIEF DESCRIPTION OF THE DRAWINGS

For a complete understanding of the present invention, references may be had to the detailed description which follows and to the accompanying drawings in which.

DETAILED DESCRIPTION OF THE INVENTION

Figure 3:
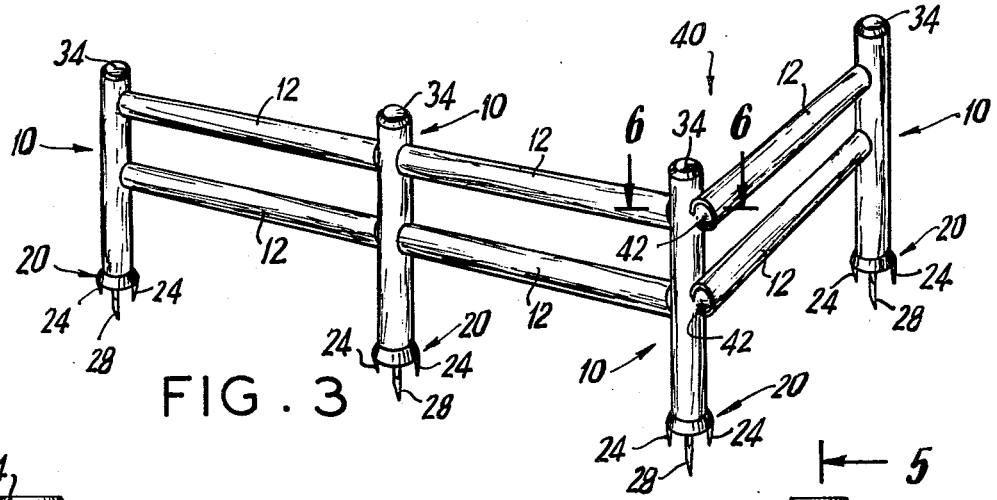
FIG. 3 is a three-dimensional pictorial view of a fence constructed in accordance with the invention.

FIG. 3 shows a fence constructed in accordance with the invention which includes a plurality of vertically upstanding posts 10. A plurality of vertical rails 12 are horizontally disposed between the posts 10. It is possible, in accordance with the invention, to utilize any desired number of parallel rails disposed one above another, but in the embodiment depicted here there are two such rails between each two successive posts.

Figure 1:
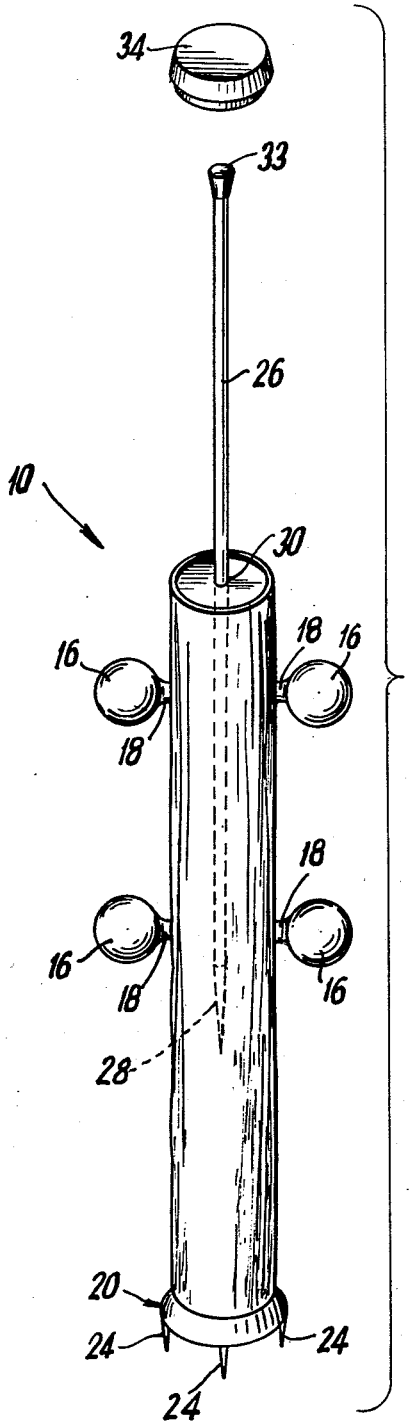
FIG. 1 is an exploded perspective view of a pole for a fence constructed in accordance with the invention.
Figure 5:
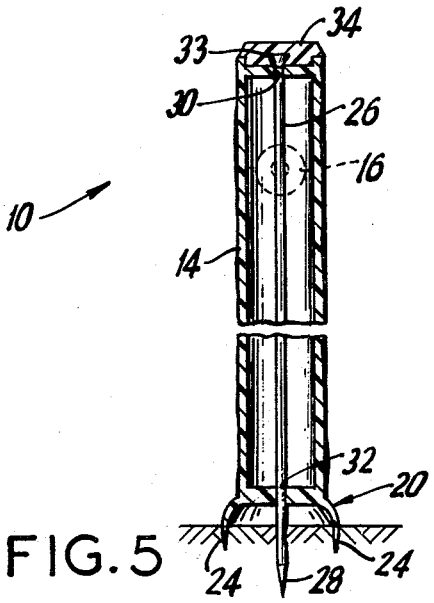
FIG. 5 is a sectional view of a fence post shown in FIG. 4 taken along the line 5—5 of that figure.

An exemplary post 10 is shown in greater detail in FIGS. 1 and 5. Each post 10 consists of a main cylindrical tube-like body portion 14 having a plurality of integrally formed bulb-like connection members 16 projecting radially therefrom. The connection members 16 project from the main body 14 of the post 10 in two opposite directions. There is one connection member 16 on each side of the post 10 for each rail 12 to be connected on that side, and the connection members 16 on one side of the post 10 are radially aligned with those on the opposite side. Each connection member 16 includes a narrow shaft-like portion 18 by which it is attached at the main body 14.

A bottom plate 20 is integrally formed with the lower end of the main body 14 but may be a separate piece. This plate 20 has a concaved bottom surface for stability and adaptability to small terrain variations and is larger in diameter than the main body 14. The bottom plate 20 also includes three downwardly projecting spikes 24 by which the post is firmly anchored to the ground.

The post further includes a rod 26 having a pointed end 28 which is inserted downwardly from the top of the main body 14 through the central axial opening 30 and then through a central opening 32 in the bottom plate 20. The top end 33 of the rod 26 is slightly flaired to secure a tight fit within the opening 30. The pointed end 28 of the rod 26 is then driven into the ground below the plate 20 until the top of the rod 26 is substandardly flush with the exposed top end of the main body 14. The rod thus provides greater support and stability for the post 10.

After the rod 26 has been driven into the ground, a cap 34 is attached to the top end of the main body 14 to cover the opening and provide a finished appearance for the post 10.

Figure 2:
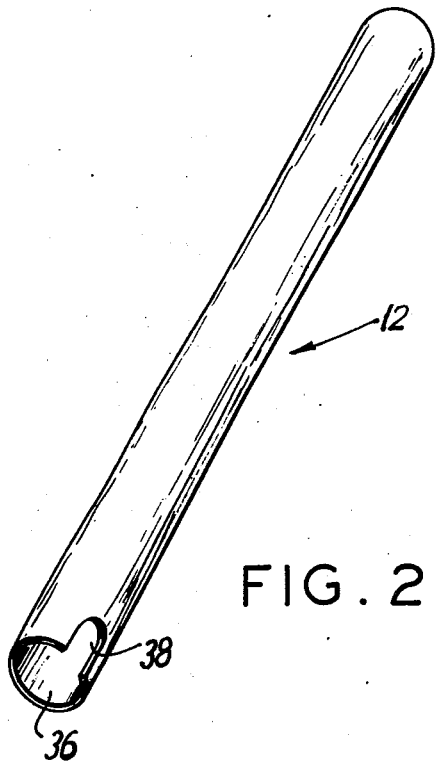
FIG. 2 is a three-dimensional pictorial view of a rail for use in a fence constructed in accordance with the invention.

A representative rail 12 of the fence shown in FIG. 3 is shown in greater detail in FIG. 2; it includes a cylindrical opening 36 at each end which is axially aligned with the rail. The axial opening 36 may extend continuously throughout the length of the rail 12 to provide openings at both ends.

Figure 4:
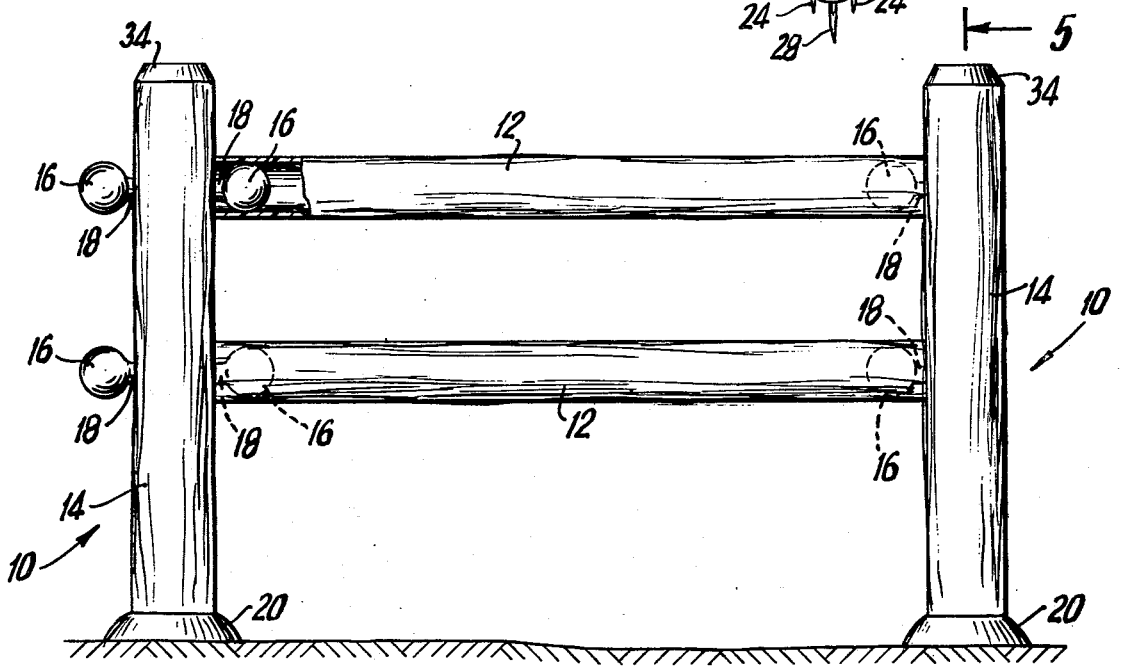
FIG. 4 is a front plan view of a portion of a fence shown in FIG. 3.

As shown in FIG. 4, the rails 12 are supported and held in place by the bulb-shaped connection members 16 of the post 10. The connection members 16 and the openings 36 are dimensioned so that the ends of the rails surround, fit over, and slidably engage the connection members 16. Each rail 12 is thus supported by the connection members 16 and cannot be removed while both of its supporting posts 10 remain in position.

When it is desired that one of the rails 12 form an angle with the supporting post 10 other than that at which the appropriate connecting member 16 projects, it is desirable to modify the rail 12 by forming a slot-like opening 38 extending axially from one end thereof. It is then possible to cause the rail 12 to extend from the post 10 in any desired direction by rotating the rail until the slot engages the shaft 18 of the connection member 16 at the point closest to the post 10. In this manner universal positioning of the rails can be accomplished.

As example of the use of slotted rails 12 forming a corner 40 is shown in FIG. 3. The technique of providing slots in the rails may be used to form corners at any desired angle and may be used to incline the rails upwardly or downwardly to accomodate ground contours.

Figure 6:
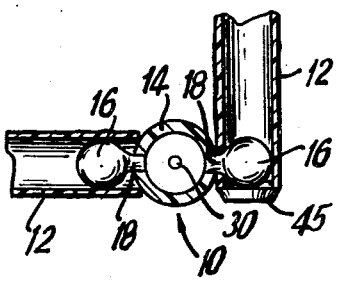
FIG. 6 is a sectional fragmentary view of the fence of FIG. 3 taken along the line 6—6 of that figure.

To provide a more finished appearance, connection members 16 on free ends of posts 10 may be sawed off as shown at the right-hand side of FIG. 4. Additionally, covers 45 similar to the caps 34 may be used at the open ends 42 of rails 12 where corners are formed. Such a cover 45 is shown as an additional element in FIG. 6. The posts 10 and rails 12 are preferably made of plastic that is roughly contoured to give the appearance of natural wood. Other materials such as aluminum may also be used.

It will be obvious to those skilled in the art that the embodiment described above is meant to be merely exemplary and that the specifications and structure of the fence are susceptible to modification and variation without departing from the spirit and scope of the invention. For example, the fence may include additional structure between the posts 10 to form a picket, mesh, or stockade fence. Therefore, the invention is not deemed to be limited except as defined by the appended claims.

What is claimed is:

1. A plurality of unassembled prefabricated fence components for on site ground assembly which comprises:

a plurality of uprightable posts, each having a plurality of connection members projecting radially therefrom in at least two opposite directions, each of said posts having an opening passing axially therethrough for receiving a rod for mounting said post in the ground, a plurality of rails for horizontal disposition between said posts, said rails having end openings axially aligned with said rails dimensioned to engage said connection members, whereby said rails can be supported at their ends by said connection members, and a plurality of rods for axial insertion through each of the axial openings of each of said posts so that said rods project from said posts for mounting and positioning said posts in the ground.

2. The unassembled fence components of claim 1, wherein the connection members projecting radially from each of said posts comprise bulb-shaped connectors each attached by a shaft-like portion to said post, and wherein the end openings of said rails are cylindrical and dimensioned to surround and slidably engage said bulb-shaped connectors.

3. The unassembled fence components of claim 2, wherein at least one of said rails has a slot at its cylindrical end opening engageable with said shaft-like portion to provide a fence corner connection.

4. The unassembled fence components of claim 2, wherein each of said posts has means at its bottom end for anchoring said post to said ground, and wherein said connection members comprise bulb-shaped connectors.

5. The unassembled fence components of claim 4, wherein each of said rods for mounting said posts is pointed at its inserting end, and wherein said anchoring means at the end of each post comprise spikes.

6. The unassembled fence components of claim 1, wherein each bottom of each post is characterized by a plate havin a concave bottom surface.

7. The unassembled fence components of claim 1, further comprising a plurality of caps for attachment to said posts at the ends opposite the ends from which said rods project.

8. The unassembled fence components of claim 1, wherein said posts and rails are made of plastic and have an exterior surface that is roughly contoured to provide a natural woodlike appeance.

9. A ground assembled prefabricated fence comprising:

a plurality of spaced vertically disposed posts having an axial opening passing therethrough, each of said posts including a bottom end having means anchoring said post in the ground, a rod passing axially through each of the axial openings in each of said posts and projecting into the ground to support said posts, a plurality of connection members projecting radially from each of said posts in at least two opposite directions, and a plurality of rails horizontally disposed between said posts, said rails having end openings axially aligned with said rails dimensioned to engage said connection members, whereby said rails are supported between said posts by their ends.

10. The assembled prefabricated fence of claim 9, wherein the connection members projecting radially from each of said posts comprise bulb-shaped connectors, and wherein the end openings of said rails are cylindrical and surround and slidably engage said bulb-shaped connection members.

11. The assembled prefabricated fence of claim 10, wherein said bulb-shaped members have shaft-like portions at points of connection to the posts, wherein at least one of said rails has a slot at its cylindrical end opening, and wherein said slot engages the shaft-like portion to provide a fence corner connection.

12. The assembled prefabricated fence of claim 9, wherein each of the bottom ends of said posts is characterized by a plate having a concave bottom surface.

13. The assembled prefabricated fence of claim 9, wherein the exterior surface of said posts and said rails is roughly contoured to provide a natural wood-like appearance.

14. The assembled prefabricated fence of claim 9, wherein said posts and said rails are made of plastic.

15. The assembled prefabricated fence of claim 9, wherein each said post includes a top end and a cap covering said top end.

* * * * *